US012624830B2

(12) United States Patent
Grossgasteiger et al.

(10) Patent No.: US 12,624,830 B2
(45) Date of Patent: May 12, 2026

(54) BURNER SYSTEM AND METHOD FOR PROVIDING THERMAL ENERGY

(71) Applicant: Siqens GmbH, Munich (DE)

(72) Inventors: Martin Grossgasteiger, Munich (DE); Marco Neumann, Munich (DE); Matthias Wössner, Munich (DE); Eilhard Stohldreier, Bad Aibling (DE); Mark Dougall Berninger, Munich (DE)

(73) Assignee: Siqens GmbH, Munich (DE)

( * ) Notice: Subject to any disclaimer, the term of this patent is extended or adjusted under 35 U.S.C. 154(b) by 787 days.

(21) Appl. No.: 17/416,193

(22) PCT Filed: Dec. 20, 2019

(86) PCT No.: PCT/EP2019/086556
§ 371 (c)(1),
(2) Date: Jun. 18, 2021

(87) PCT Pub. No.: WO2020/127892
PCT Pub. Date: Jun. 25, 2020

(65) Prior Publication Data

US 2022/0057083 A1 Feb. 24, 2022

(30) Foreign Application Priority Data

Dec. 21, 2018 (DE) ..... 10 2018 133 529.6

(51) Int. Cl.
*F23D 11/44* (2006.01)
*F23D 11/22* (2006.01)
(Continued)

(52) U.S. Cl.
CPC ..... *F23D 11/445* (2013.01); *F23D 11/22* (2013.01); *F23D 2207/00* (2013.01); *F23D 2900/31022* (2021.05); *F23N 2237/14* (2020.01)

(58) Field of Classification Search
CPC .. F23C 2700/026; F23D 11/22; F23D 11/445; F23D 2207/00; F23D 2900/21002;
(Continued)

(56) References Cited

U.S. PATENT DOCUMENTS 1,385,905 A * 7/1921 Coulter ..... F23D 11/443 431/217
1,615,321 A * 1/1927 Banks ..... F23D 11/443 431/229
(Continued)

FOREIGN PATENT DOCUMENTS

CH 116460 1/1927
CH 116460 A 1/1927
(Continued)

OTHER PUBLICATIONS

German Search Report, mailed on Aug. 29, 2019, from German Application No. 10 2018 133 529.6, filed on Dec. 21, 2018. 7 pages.
(Continued)

*Primary Examiner* — Michael G Hoang
*Assistant Examiner* — Logan P Jones
(74) *Attorney, Agent, or Firm* — HoustonHogle LLP

(57) ABSTRACT

The present invention relates to a burner system for providing thermal energy comprising an evaporator device for evaporating a liquid alcohol fuel, a burner air supply means, a burner device for burning a fuel mixture comprising vaporized fuel and burner air to provide an exhaust gas stream, a functions device for controlling the thermal energy of the exhaust gas flow, wherein the burner device provides
(Continued)

Figure 1:
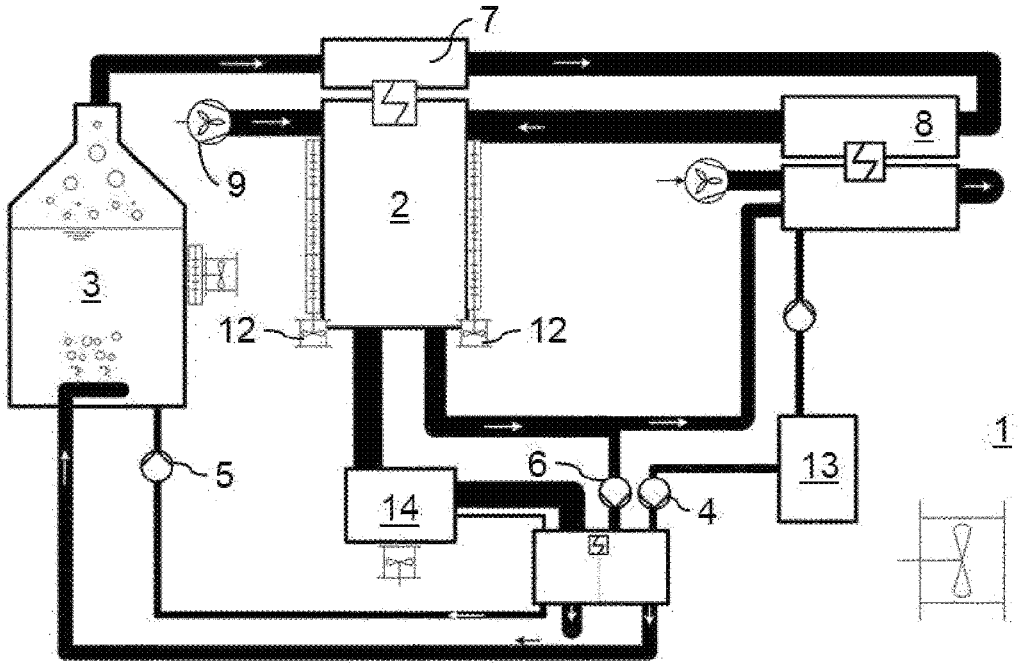

the thermal energy for evaporation in the evaporator device during operation.

13 Claims, 3 Drawing Sheets

(51) Int. Cl.
*H01M 8/04014* (2016.01)
*H01M 8/0612* (2016.01)
*H01M 8/1018* (2016.01)

(58) Field of Classification Search
CPC ..... F23D 2900/31022; F23N 2237/14; H01M 8/04022; H01M 8/0625; H01M 8/1018; Y02E 60/50
See application file for complete search history.

(56) References Cited

U.S. PATENT DOCUMENTS

| | | | | | |
|---|---|---|---|---|---|
| 1,636,125 | A | * | 7/1927 | Chapman | F23D 11/44 220/327 |
| 4,480,988 | A | * | 11/1984 | Okabayashi | F24H 1/145 126/92 R |
| 4,588,659 | A | * | 5/1986 | Abens | H01M 8/04 48/102 A |
| 5,169,303 | A | * | 12/1992 | Paluck | F23Q 3/004 431/74 |
| 5,372,115 | A | | 12/1994 | Straub et al. | |
| 6,033,793 | A | * | 3/2000 | Woods | H01M 8/0625 95/55 |
| 6,301,890 | B1 | | 10/2001 | Zeretzke | |
| 9,285,114 | B2 | | 3/2016 | Tsumagari et al. | |
| 2017/0254266 | A1 | | 9/2017 | Milani et al. | |

FOREIGN PATENT DOCUMENTS

| | | | | |
|---|---|---|---|---|
| CN | 101245911 | A | | 8/2008 |
| CN | 101540410 | A | | 9/2009 |
| CN | 102585913 | A | | 7/2012 |
| CN | 104847425 | A | | 8/2015 |
| CN | 108469024 | A | | 8/2018 |
| DE | 272 1 818 | A1 | | 11/1977 |
| DE | 3152948 | A1 | | 11/1983 |
| DE | 3226023 | A1 | * | 1/1984 |
| DE | 199 10 387 | A1 | | 9/2000 |
| DE | 199 31 061 | A | | 1/2001 |
| DE | 10 2006 018 362 | A1 | | 10/2007 |
| DE | 10 2008 057 146 | B4 | | 5/2010 |
| DE | 10 2009 026 266 | A1 | | 2/2011 |
| DE | 10 2011 050 368 | A1 | | 11/2012 |
| DE | 10 2012 101 580 | A1 | | 8/2013 |
| DE | 10 2014 103 814 | A1 | | 9/2015 |
| EP | 1 703 578 | A1 | | 9/2006 |
| EP | 23 15 493 | A1 | | 4/2011 |
| EP | 2 706 052 | A2 | | 3/2014 |
| FR | 318907 | A | * | 10/1902 |
| FR | 321364 | A | * | 1/1903 |
| FR | 341526 | A | * | 8/1904 |
| JP | S57-134606 | | | 8/1982 |
| JP | S57134606 | A | | 8/1982 |
| JP | 58214704 | A | * | 12/1983 |
| JP | S61240022 | A | | 10/1986 |
| JP | H06-147 427 | A | | 5/1994 |
| JP | H094817 | A | | 1/1997 |
| KR | 20150128311 | A | | 11/2015 |
| WO | WO 2010066900 | A1 | | 6/2010 |
| WO | WO 2015110545 | A1 | | 7/2015 |

OTHER PUBLICATIONS

International Search Report of the International Searching Authority, mailed on Apr. 17, 2020, from International Application No. PCT/EP2019/086556, filed on Dec. 20, 2019. 5 pages.
Written Opinion mailed on Apr. 17, 2020, from International Application No. PCT/EP2019/086556, filed on Dec. 20, 2019. 9 pages.
International Preliminary Report on Patentability, mailed on Jul. 1, 2021, from International Application No. PCT/EP2019/086556, filed on Dec. 20, 2019. 20 pages.

* cited by examiner

BURNER SYSTEM AND METHOD FOR PROVIDING THERMAL ENERGY

RELATED APPLICATIONS

This application is a § 371 National Phase Application of International Application No. PCT/EP2019/086556, filed on Dec. 20, 2019, now International Publication No. WO 2020/127892 A1, published on Jun. 25, 2020, which International Application claims priority to German Application 10 2018 133 529.6, filed on Dec. 21, 2018, both of which are incorporated herein by reference in their entirety.

The present invention relates to a burner system and a method for providing thermal energy.

In the case of fossil energy sources, such as coal, gas and oil, the carbon present is irreversibly converted into carbon dioxide during combustion, thus promoting the greenhouse effect, which leads to global warming.

One alternative to these energy sources is methanol. Methanol is a very widely used industrial chemical that is less popular as a fuel in Europe and the USA. In addition to its use as a fuel, methanol can be used as an energy store through chemical reaction. The function of an energy store is based on its controlled absorption of an amount of energy that can be released again with a time delay.

Surface burners are increasingly being used for low-power burners, especially burners for domestic heating. With this principle, the burner head consists of a porous material. High-heat-resistant metal or ceramic fiber is usually used for this. Fuel and air are premixed and burn as they flow through the burner head. Due to the small flow channels, the heat of reaction is well convected to the material of the burner head. The heat radiates from the burner head to the walls of the boiler. The annealing temperature of the burner head is set between 700° C. and 900° C. In this temperature range, the formation of thermal NOx is inhibited. The burners are thus characterized by extremely low NOx emissions.

In terms of the shape of the burner head, burners are divided into flat burners, cylindrical burners and hemispherical burners.

A "ceramic foam burner" is known as a flat-surface burner head. In this burner, a gas-air mixture flows through a burner head made of ceramic foam and ignites on its inner surface. Combustion takes place on the porous surface.

The Magma burner is known as a burner with a cylindrical head. Its head consists of a stainless steel screen surrounded by a ceramic fiber layer. The fine-grained ceramic layer has aluminum silicate inclusions to achieve higher heat resistance. The gas-air mixture is supplied in a twisted form.

A burner head with a hemispherical shape is the matrix burner. The surface consists of a high-alloy stainless steel wire mesh.

A fuel cell is a galvanic cell that converts the chemical reaction energy of a continuously supplied fuel and an oxidant into electrical energy. The classification of the different types is based on the one hand on the electrolyte (e.g. polymer electrolyte membrane fuel cell, PEMFC) and on the other hand on the fuel used (e.g. DMFC).

WO 2010/066900 A1 discloses a humidification unit for providing a fuel- and water vapor-containing carrier gas for supplying a fuel cell. The humidification unit comprises a humidification space designed to receive a fuel-containing liquid, an inlet opening into the humidification space for supplying a fuel-containing liquid, a further inlet opening into the humidification space for supplying a carrier gas in such a way that the carrier gas is in contact with the liquid in the humidification space. Furthermore, an outlet is provided for discharging the carrier gas containing gaseous fuel, a control device being provided which sets the fuel-containing liquid in the humidification chamber to a temperature below its boiling point. The control device is designed in such a way that the vapor pressures of the fuel and water vapor are regulated by adjusting the fuel concentration and the temperature of the fuel-containing liquid.

WO 2015/110545 A1 discloses a fuel cell system for thermally coupled reforming with reformate processing. This system comprises a fuel cell stack having an anode inlet, an anode outlet, a cathode inlet and a cathode outlet, and a steam reforming reformer thermally coupled to the fuel cell stack for providing an anode fluid comprising reformed fuel, which is connected upstream of the anode inlet. The fuel cell stack and the reformer device are thermally coupled in such a way that the waste heat of the fuel cell stack is transferred by means of heat conduction to the reformer device and is partially used for operating the reformer device, and at least one processing device arranged between the reformer device and the anode inlet being provided for removing and/or reforming unreformed fuel and/or substances harmful to the fuel cell stack from the anode fluid, an operating temperature of the fuel cell stack being in the range between 140° C. and 230° C.

In order for fuel cell stacks to reach their operating temperature, an electrical heating device is usually provided.

In EP 2 706 052 A3, a method and a device for using methanol in an internal combustion engine are known. A corresponding system can be heated by means of a parking heater in order to start the system.

U.S. Pat. No. 5,372,115 A discloses a fuel system for a diesel internal combustion engine that can be operated with methanol and other liquid fuels in the manner of a dual fuel system.

An oil vaporization burner is known from the Buderus company. Here, it is intended to inject heating oil into strongly preheated burner air. The surface area of the heating oil is increased by atomization during injection by means of an injection valve, and the energy required for evaporation is provided by the introduction of hot air.

EP 1 703 578 A1 discloses a gas-powered starting system for a reformer fuel cell system.

This comprises at least one reformer, a fuel cell and a burner arranged outside the fuel cell, such as a low flame height surface burner, e.g. a burner with a ceramic or metallic surface or a surface made of fiber materials, such as a ceramic fiber mat coated with silicon carbide, to heat the reformer and fuel cell stack.

DE 199 10 387 A1 describes a fuel cell battery with a stack and a heating device. The heat provided by the heating device is to be usable for heating the fuel cell stack. In this fuel cell battery, at least one process gas channel can be provided in order to provide thermal energy by means of a heat transport medium. A heating device is defined as any heatable space in which a heat transport medium can be heated, also by using a heat exchanger. The heating device preferably comprises a heating element such as a catalytic burner and/or an electric heating element or a reformer.

DE 199 31 061 A discloses a fuel cell system with a cooling circuit. A heat sink is connected to a supply line for the fuel and/or oxidant in such a way that a corresponding heat exchange can take place. Thus, it should be possible to heat the gas/fluid flows of the fuel cell with the waste heat of a cooling system.

DE 272 1 818 A1 shows a burner for burning liquid fuel with an evaporator. The evaporator is heated exclusively electrically.

DE 10 2008 057 146 B4 discloses a fuel-operated vehicle heater with a jet pump for combustion air.

An evaporator burner with an evaporator is known from DE 10 2011 050 368 A1.

In DE 10 2012 101 580 A1, a mobile burner operated with liquid fuel with a primary and secondary combustion zone as well as an air guiding device for recirculating the combustion air in order to enable a good mixing of combustion air and fuel. Another such burner is also known from DE 10 2014 103 814 A1.

EP 23 15 493 A1 discloses an electrical resistance heating device for heating air supplied to a vehicle interior.

U.S. Pat. No. 9,285,114 B2 refers to a diesel particulate filter (DPF).

DE 10 2009 026 266 A1 discloses a mobile heating device in which a fuel propellant jet is generated via an injector.

It is therefore the object of the present invention to provide a burner system for generating thermal energy which is simple and inexpensive in design and safe and reliable in operation.

Another task is to provide an environmentally friendly and compact burner system that can be used flexibly.

This task is solved with a device according to claim 1 and a method according to claim 9. Advantageous embodiments thereof are indicated in the subclaims.

The present invention relates to a burner system for providing thermal energy comprising an evaporator device for evaporating a liquid fuel,

- a burner air supply device,
- a surface burner for burning a fuel mixture comprising vaporized fuel and burner air to provide an exhaust gas stream,
- a shielding plate with openings for passing and controlling the thermal energy of the exhaust gas flow, the burner device providing, in operation, the thermal energy and the vaporization temperature required for complete vaporization of the fuel in the evaporator device, and
- a tertiary air supply means for supplying tertiary air to control the temperature of the exhaust gas stream by mixing with the tertiary air to form a hot gas stream.

The burner air supply device is also referred to below as the primary/secondary air device.

In the context of the present invention, complete vaporization of the fuel, preferably methanol, is understood to be the complete phase transition of a liquid or a liquid mixture into the gaseous aggregate state from or above the boiling temperature of the liquid or the liquid mixture.

The evaporation temperature required for complete evaporation depends on the fuel used. In the case of methanol, for example, this is an evaporation temperature in the range between 64.7° C. and approx. 150° C.

The surface burner can also be designed as another suitable burner device, such as a volumetric burner with ceramic or metal foam or a catalytic burner, whereby the catalytic coating can be applied to ceramic, metallic monoliths or also to foams or sheets.

The tertiary air supplied by the tertiary air device enables the output temperature of the useful or hot gas flow to be regulated or controlled during burner operation.

With the burner system according to the invention, fuel and burner air can be regulated or controlled independently of each other in order to make power adjustments or the temperature of the hot air flow both by changing the air lambda and via a constant air lambda when reducing (or increasing) the fuel and (and/or) the air.

In addition, the tertiary air can be used to cool another device, e.g. a fuel cell stack, when the burner device or the surface burner is not in operation.

A thermal sensor can be provided in front of a blower or a fan of the tertiary air supply device to protect it from overheating.

The ambient air (tertiary air) conveyed via the tertiary air device is mixed with the exhaust gas in such a way that its temperature is cooled both to a desired initial temperature and to a suitable level for evaporation.

With the burner device according to the invention, the temperature of the evaporator device can thus be actively controlled. Overheating of the evaporator can be prevented by supplying tertiary air.

In combination with the shielding plate or the baffle plate (functions device), this design allows the use of very heat-conductive materials such as aluminum in the evaporator device. Furthermore, a controlled temperature of the evaporator device can also successfully prevent thermal decomposition of the fuel, which could otherwise lead to sooting and thus to clogging of the evaporator device and damage to the burner device or the surface burner.

The shielding plate or the baffle plate (functions device) itself is preferably a passive element, the control takes place via the tertiary air (tertiary air device; tertiary air blower) or the gas flows. There is no exhaust gas recirculation. Such recirculation is also not necessary, as the surface burner enables significantly cleaner combustion. In addition, no further preheating of the surface burner by exhaust gas is necessary during operation, since the fuel vapor is already sufficiently superheated in the evaporator device and sufficient energy is already returned from the burner surface via heat conduction. Furthermore, the baffle plate controls not only the thermal energy input into the evaporator device but also the temperature level of the hot gas flow, which can then be used, for example, to heat a fuel cell stack.

The baffle plate and the tertiary air device are designed in such a way that both the temperature level of the hot gas applied to the evaporator device can be adjusted and the output temperature of the burner can be controlled.

The surface burner does not require any special measures for flame stabilization, as this can already be done via a metal fiber surface. The fuel-steam-air mixture can also be provided with a swirl in a spiral of the burner, but this serves exclusively to mix and distribute the fuel gas over the cross-section of the burner surface.

The shielding plate or baffle comprises openings for passing and regulating or controlling the thermal energy of the exhaust gas flow and/or can be designed for thermal shielding of the evaporator device. Furthermore, it can be provided that the area of the openings of the shielding plate can be changed or enlarged or reduced by means of a corresponding adjustment device in order to carry out a corresponding control.

The shielding plate thus provides radiation shielding of the evaporator device, since the surface burner is operated in radiation mode, as well as mixing of the hot burner exhaust gas with the tertiary air in order to reduce the overall exhaust gas temperature. This also has the effect that the temperature applied to the evaporator device is not in the range of the thermal decomposition of the fuel. The controlled superheating of the fuel vapor in this way enables the use of less expensive valves and seals in the vapor line.

The shielding plate can be, for example, a stainless steel sheet with a suitable thickness.

The shielding plate can be part of an evaporator chamber of the evaporator device and thus be an integral part of the evaporator device. In this case, the shielding plate or the baffle plate has an effect on the temperature distribution and uniformity towards the evaporator chamber.

In order to protect the downstream heat exchanger of the evaporator device from excessive heat input by radiation, the shielding plate can have heat sinks to absorb radiant energy and bring the heat input to a suitable level by releasing it via convection.

The functions device or the shielding plate is designed to shield and/or control a heat flow.

Without a shielding plate, there is a risk that the heat transfer by thermal radiation (burner device is operated in radiation mode to form little burnout and a combustion chamber with a shallow depth to keep the installation space as small as possible) is so strong that the material of a heat transfer device surrounding the evaporation space would melt, even if the gas flowing through has already been lowered below the melting point by tertiary air.

The shielding plate itself can also be cooled by means of the tertiary air, as otherwise it can start to glow after some time and then the radiation portion of the heat transport increases again and can lead to the same problem as without the shielding plate. Basically, the shielding plate is a heat transport transformer in which heat energy is absorbed in the form of a lot of radiation and little convection and heat energy is emitted with a lot of convection and little radiation.

The evaporator device can be coupled to the burner device via the shielding plate in such a way that the thermal energy of the exhaust gas flow of the burner device is used in operation after a start-up phase to completely evaporate the liquid fuel in the evaporator device.

In the fuel system according to the invention, neither a powerful fuel pump to atomize the fuel nor an injection nozzle to atomize the fuel is provided. Therefore, according to the invention, it is intended to vaporize the fuel completely in the evaporator device.

The evaporator device can preferably be of closed design. In the context of the present invention, a closed evaporator device means that the liquid fuel is evaporated in an evaporator chamber, the outlet of which is only connected to an inlet of the burner device via a pipe section (steam pipe). Liquid fuel is supplied to the evaporator chamber via a corresponding inlet, otherwise the evaporator chamber is closed.

The burner system according to the invention can feed the fuel to the evaporator chamber with a simply constructed fuel pump, since the evaporator device is capable of ensuring uniform evaporation with unsteady fuel delivery.

The evaporator device of the burner system only needs one evaporation branch and not two or more evaporation branches that have to be controlled via valves. The electric heater in the evaporator device can be switched off in stages on the basis of empirical values (temperature detection is also possible). How such empirical values can be determined is described in detail in the following example.

Furthermore, in the burner system according to the invention, fuel and burner air can be controlled independently of each other in order to make power adjustments both by changing the air lambda and by keeping the air lambda constant when reducing the fuel and the air.

The above advantages are described in more detail in the following example.

The burner system can preferably be surrounded by a housing device slightly spaced from the components of the burner system.

The thermal energy of the exhaust gas flow can be provided in the form of tempered air (hot gas flow), whereby the thermal energy can be delivered directly or via a separate heat exchanger device to a device coupled to the burner system, whereby this device is an internal combustion engine or a fuel cell stack or a battery or an air ducting device for heating a vehicle interior.

The tempered air is initially still diluted exhaust gas that can then be fed to an air-to-air heat exchanger device to form tempered air.

The various types of fuel cells and their respective operating temperatures (OT) that can be heated in conjunction with the burner system according to the invention are briefly listed below.

Alkaline fuel cell (AFC); OT: 60° C. to 100° C.;

Polymer electrolyte membrane fuel cell (PEMFC); OT: Low temperature: 70° C.-90° C.; High temperature: 120° C.-190° C.;

Direct methanol fuel cell (DMFC); OT: 60° C. to 130° C.;

Phosphoric acid fuel cell (PAFC); OT: 170° C. to 200° C.;

Molten carbonate fuel cell (MCFC); OT: approx. 650° C.;

Solid oxide fuel cell (SOFC); OT: 900° C. to 1000° C.;

The tempered air can be delivered to or coupled with an oil circuit of a vehicle or an engine of a vehicle or a cooling circuit of a vehicle, e.g. via an air-air or air-fluid heat exchanger, in order to preheat the engine, preferably an internal combustion engine.

This burner system can also form a thermal range extender and enables battery-powered vehicles to operate more independently of the charging infrastructure and, with the usual comfort, increases the range in colder seasons.

Furthermore, instead of using electrical energy from an expensive battery, a vehicle interior can be heated with inexpensive—also renewable—methanol.

For example, a vehicle interior can be heated via the burner system by means of an air-to-air heat exchanger. In this case, a similar construction can be provided as in EP 23 15 493 A1, which, however, uses an electrical resistance heating device instead of the burner system according to the invention.

By integrating it into the cooling system of a vehicle, a vehicle battery can also be kept at operating temperature. The energy density of methanol is 35 times higher per kg compared to a lithium-ion battery.

In methanol engines, the burner system enables problem-free starting without a dual fuel system.

By means of the burner system according to the invention, thermal energy is thus provided from clean liquid fuels. In the context of the present invention, alcohols, such as methanol, ethanol, 2-propanol, 2-butanol, etc., are particularly envisaged as liquid fuels. It is also possible to use fuels such as petrol or paraffin or other liquid fuels with boiling temperatures up to 350° C.

In particular, the following advantages can be achieved with the burner system according to the invention:

$CO_2$ neutral operation with regenerative methanol

Works with globally available methanol>35% cheaper than diesel

Quiet operation—under 35 dB(A)

Stepless regulation of the heating power and temperature

Compact installation dimensions—high energy density, low burnout

Low-emission operation due to combination of surface burner and clean fuel

Increasing the range of battery electric vehicles at low temperatures

Suitable for continuous operation

Easily adaptable to other fuels

Keeps batteries at operating temperature even in demanding environments

Based on a surface burner with fan that is operated with methanol steam

In addition to heating, it can also be able to cool the fuel cell

Defined output temperature of the hot gas is adjustable

Low pressure loss for use of simple, low-cost fans

Can be used with already qualified dosing pumps (discontinuous delivery)

Robust, reliable and safe operation

In order to optimize the competitiveness of fuel cell systems in comparison with conventional generators, it is now possible, in conjunction with the burner system according to the invention, to solve the problems mentioned at the beginning with regard to the starting time and the electrical heating system, among other things, when heating up a fuel cell stack.

For the start-up process, a fuel cell stack, e.g. of a HT-PEM fuel cell system, is no longer heated electrically, but is heated to 140° C. to 230° C. or to 160° C. to 180° C. and in particular to approx. 165° C. by means of the exhaust gas flow of the burner system.

The burner device can be designed as a surface or area burner, which comprises a burner screen and a metal fiber mesh connected together, a diffuser, an ignition device and preferably a flame monitoring device.

The surface burner has a cost and installation space advantage over a catalytic burner.

In addition, the surface burner offers more degrees of freedom here, as it can easily be run with slightly more or less load without having to use more expensive catalyst. In addition, a burner based on catalytic reaction has narrower limits for power modulation (lower temperature limits (approx. 800° C.) as the catalyst is damaged above this; higher air lambda necessary, thus higher exhaust gas loss; catalyst-dependent upper limit for the ratio between catalyst volume and volume flow, if this is exceeded the catalyst no longer converts the fuel gas completely).

Such a surface burner only has a low burnout, with a combustion chamber measuring approximately height×width×depth=approx. 95 mm×141 mm×49 mm.

Another advantage of the surface burner is that it is very pulsation-free and low-noise due to the laminar flow.

Mixture preparation is preferably carried out before the burner surface (premix burner). A mixing spiral can be provided for this purpose.

In principle, the burner device is only suitable for gaseous fuels. Preferably, completely vaporized methanol is provided for this purpose.

Known gas burner components in the form of a flame monitoring device can be provided for flame monitoring.

The primary/secondary air supply may be provided for supplying primary air to form the fuel mixture, this being supplied to the fuel vapor prior to combustion, and/or secondary air for cooling the burner device, in particular the diffuser and/or the combustion chamber and/or for post-combustion.

The primary air is mixed with the vaporized fuel (methanol) to form a fuel mixture. Only a part of this is used if there is not enough primary air available for complete primary-side combustion. The secondary air is mixed with the primary side exhaust gases and, depending on the operation, a portion is then converted or only serves as a mixing gas.

The fuel may be only partially used (rich mixture). The primary air is either fully utilized (lambda<=1) or there is still oxygen left because of lean operation (lambda>1).

The fuel-air ratio lambda ($\lambda$) can thus be adjusted by specific fuel regulation and/or air regulation. At operating conditions $\lambda<1$, a rich mixture is present and the energy of the fuel may not be fully utilized. At operating states above $\lambda>=1$, the entire primary air ($\lambda=1$) is used or oxygen molecules remain over ($\lambda>1$). A corresponding control device can be provided for adjustment.

Depending on the mode of operation, the secondary air provides the burner equipment with air for any necessary afterburning. The secondary air provides the burner with sufficient oxygen to ensure complete combustion, even with rich combustion on the primary side.

The secondary air cools the combustion chamber walls and the diffuser, making it possible to use silicone seals on the diffuser. In this way, the thermal load on the combustion chamber housing is significantly reduced.

The temperature-controlled hot gas flows through or around a heat exchanger device of the evaporator or an evaporation chamber of the evaporator in order to heat the evaporator or to provide the energy for the evaporation.

The temperature upstream of the heat exchanger and/or in the exhaust line can be measured with suitable temperature sensors in order to provide appropriate regulation or control to achieve a suitable output temperature and not overheat the evaporator device.

The hot gas is produced by mixing the burner exhaust gas with the tertiary air in a flow direction directly behind a shielding plate or the functions device and in front of the evaporator device.

In order to achieve uniform mixing and flow distribution over the entire evaporator cross-section, correspondingly designed openings in the shielding plate are positioned in such a way that they lie directly at the inflow openings of a tertiary air duct into the mixing chamber. The two air streams therefore meet at an angle of 90° and mix. Mixing the tertiary air with the burner exhaust gas makes sense in order not to overheat the fuel vapor too much and to enable the use of low-cost standard valves between the evaporator and the burner.

The tertiary air duct can also be designed as a spiral into which the combustion air is fed. In addition to the meeting of the two gas flows at a 90° angle, further mixing is achieved in the spiral.

The evaporation in the evaporator device thus takes place via the burner waste heat or via the thermal energy contained in the exhaust gas flow in order to save electrical energy during operation. The hot gas flows through a heat transfer device of the evaporation chamber.

Furthermore, a fuel supply device or fuel pump can be provided for supplying liquid alcoholic fuel to the evaporator device. In combination with a fuel cell system, this can be an existing anode pump of the fuel cell system or preferably a fluid pump.

The fuel supply device preferably comprises a fuel tank and a pump.

In addition, a mixing device can be provided in which the fuel vapor produced in the evaporator device by complete evaporation is mixed with the primary air. The mixing device is designed in the shape of a spiral and is integrally formed on a rear wall of a diffuser of the burner device.

By using the shielding plate in combination with the cooling of the burner exhaust gas via the tertiary air flow, aluminum with its good heat conduction properties can be used as the material for the evaporator without being damaged by the high combustion temperatures, above the melting point of aluminum.

The following media flows can be provided in the burner system according to the invention:

Burner air consisting of:

- Primary air: Air that is used directly for combustion and is already mixed with the fuel vapor before combustion.
- Secondary air: Air that flows around the diffuser at the edge into the combustion chamber to cool the diffuser and the combustion chamber. It is available for afterburning, which may be necessary depending on the mode of operation. The secondary air provides the burner with sufficient oxygen to ensure complete combustion, even with rich combustion on the primary side.

Hot gas consisting of:

- Exhaust gas: Total gas flow exiting the combustion chamber consisting of the primary/secondary air components and the gases produced during combustion.
- Tertiary air: Ambient air conveyed via a second fan (tertiary air fan) which is mixed with the exhaust gas to cool its temperature both to a desired initial temperature and to a suitable level for evaporation.
- Fuel vapor: Fuel vapor produced in the evaporator by complete evaporation which is mixed with the primary air in a mixing device.

According to a preferred embodiment of the present invention, a 3/2-way valve is arranged in a pipe section that connects an outlet of the evaporator device with a fuel inlet or the mixing device of the burner device.

In this way, it is possible to interrupt the fuel supply from the evaporator device to the burner device in order to ensure that the flame extinguishes within three seconds as required by the standards.

Since there is also liquid methanol in the lower area of the evaporator device, switching off a fuel pump does not extinguish the flame in time, since the methanol would still evaporate completely due to the existing waste heat of the burner device.

By providing the 3/2-way valve, the outlet of the evaporator can be kept open during heating.

The methanol remaining in the evaporator after the last operation can be degassed without causing a pressure increase in the evaporator.

Since the internal pressure of the evaporator at the time of switching the valve to the burner device is approximately the same as the ambient pressure, no pressure can be discharged into the burner device, and it can be started up correspondingly more gently with a controlled fuel/methanol/air mixture.

In order not to lose any methanol to the environment, the methanol outgassing from the evaporator during the heating and cooling phase is returned to the burner system. The methanol passes through a hose connection into a phase separation or condensation device, where it is condensed out and returned to the system. The outgassing methanol is thus returned to the burner system. If the burner system is used in conjunction with a fuel cell system, the outgassed methanol is fed to the fuel cell system or a methanol tank of the system.

Another advantage of using the 3/2-way valve is that the methanol evaporating and outgassing during heating is used as a heat transfer medium to preheat the evaporator and the piping more evenly in the upper part. Since a heating device is integrated in a lower part of the evaporator, this part is preheated to a correspondingly greater extent, since the heat conduction of the material is limited. However, the evaporating methanol adds an additional heat transport mechanism. Methanol that condenses again in cold areas of the evaporator can flow back down and evaporate again if the evaporator is installed in the normal position.

In order to intensify this effect, a limited amount of methanol is already pumped into the evaporator system about 10 seconds before the valve is switched to the burner, i.e. the evaporator system is already in operation. The methanol vapor, which may still contain unapprised liquid methanol at this time, is then returned to the burner system accordingly.

This also makes it possible to eliminate the dead time of the evaporator device (time between the entry of the liquid methanol and the exit of the gaseous methanol vapor) for the ignition phase of the burner device, as this has already been passed through before the start of the ignition phase.

Furthermore, a method according to the invention for providing thermal energy is provided, which comprises the technical features explained above and the corresponding advantages.

A method for providing thermal energy comprises the following steps:

- Heating an evaporator device with an electrical heating device during a start-up phase, complete evaporation of a liquid fuel in the evaporator device,
- Feeding the fully vaporized fuel to a burner device, preferably a surface burner, and
- Burning the vaporized fuel in the burner device to provide thermal energy in the form of an exhaust gas stream,
- Use of a portion of the thermal energy in operation of the burner system to vaporize the fuel in the evaporator device during operation so that the energy for vaporization in the evaporator is provided solely by the burner device.

The diffuser can also be preheated and heated electrically. Preferably, a second heating device is provided for this purpose, which can be regulated or controlled independently of the heating device of the evaporator.

Regulation or control of the thermal energy of the exhaust gas flow can take place between the burner device and the evaporator device via openings formed in a shielding plate or a functions device.

The burner device may comprise a surface burner for gaseous fuels, whereby the fully vaporized fuel is burnt in the surface burner.

Primary air may be supplied to form a fuel mixture, the primary air being supplied to the fuel vapor prior to combustion, and/or secondary air may be supplied, which is provided for cooling the diffuser and/or the combustion chamber of the burner device, and/or used for post-combustion, wherein the primary and secondary air is supplied from a burner air supply means, referred to as primary/secondary air.

Tertiary air can be supplied to adjust a temperature of the thermal exhaust gas stream by mixing with the tertiary air so that a hot gas stream is formed therefrom, wherein control of the output temperature of the hot gas stream in burner operation is effected via the tertiary air.

Via a 3/2-way valve, an outlet of the evaporator device can be kept open during a start-up phase (heating of the evaporator device) and/or, upon termination of the operation of the burner device, methanol remaining in the evaporator device can be degassed via the 3/2-way valve without causing a pressure increase in the evaporator device, wherein an internal pressure of the evaporator device at the time of switching the valve to the burner device corresponds approximately to the ambient pressure, so that no pressure is discharged in the burner device and the latter is started up with a controlled fuel-air mixture.

In addition, a mixing device (or its diffuser) can also be preheated in a start phase with an electric heating device.

Figure 2:
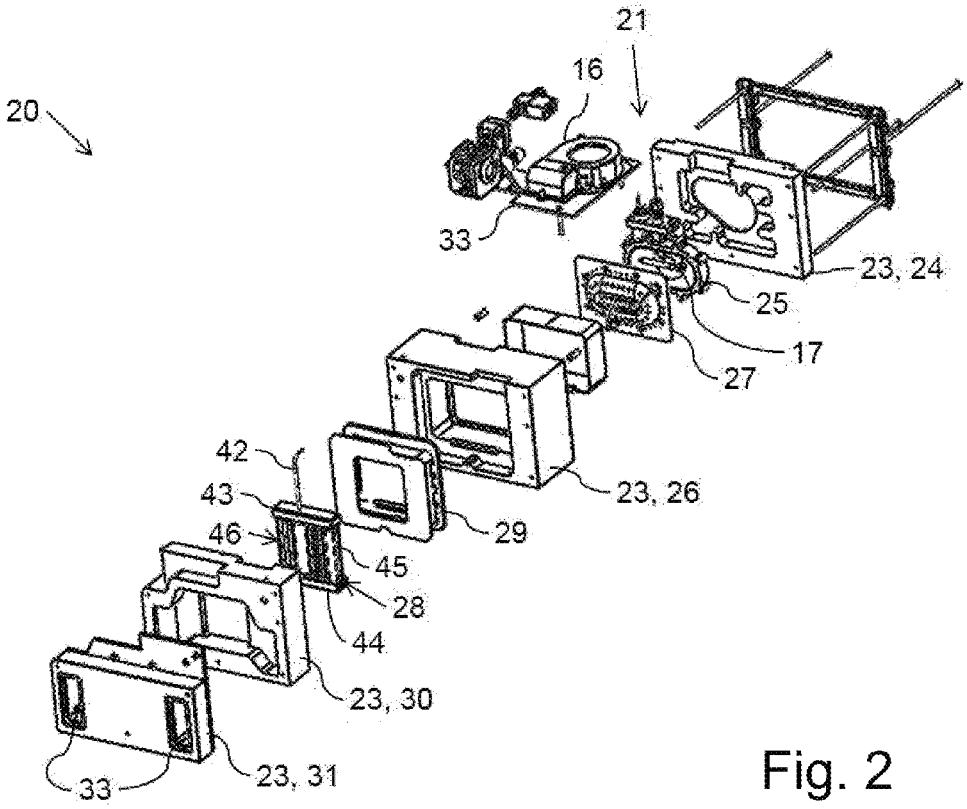
Figure 3:
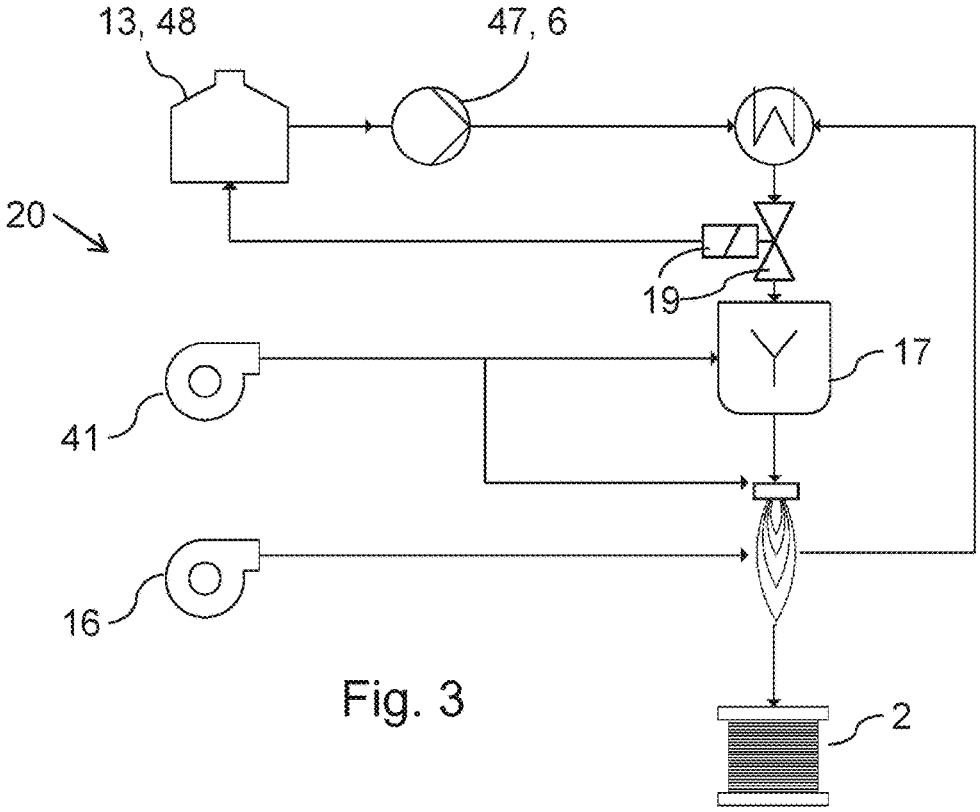
Figure 4:
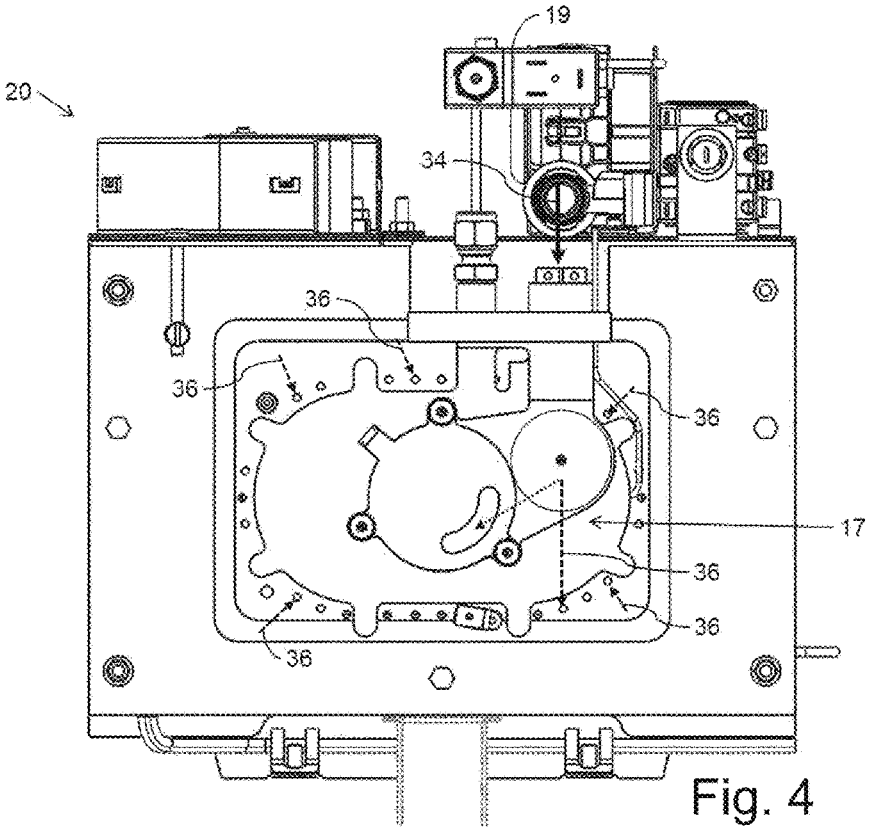
Figure 5:
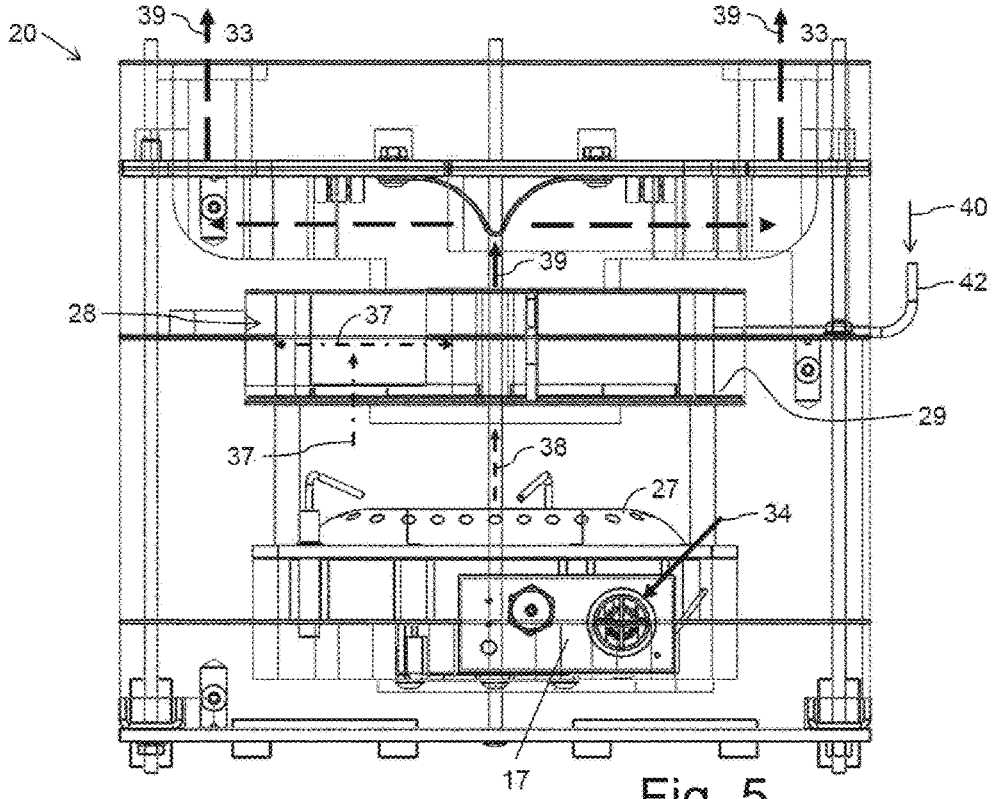
Figure 6:
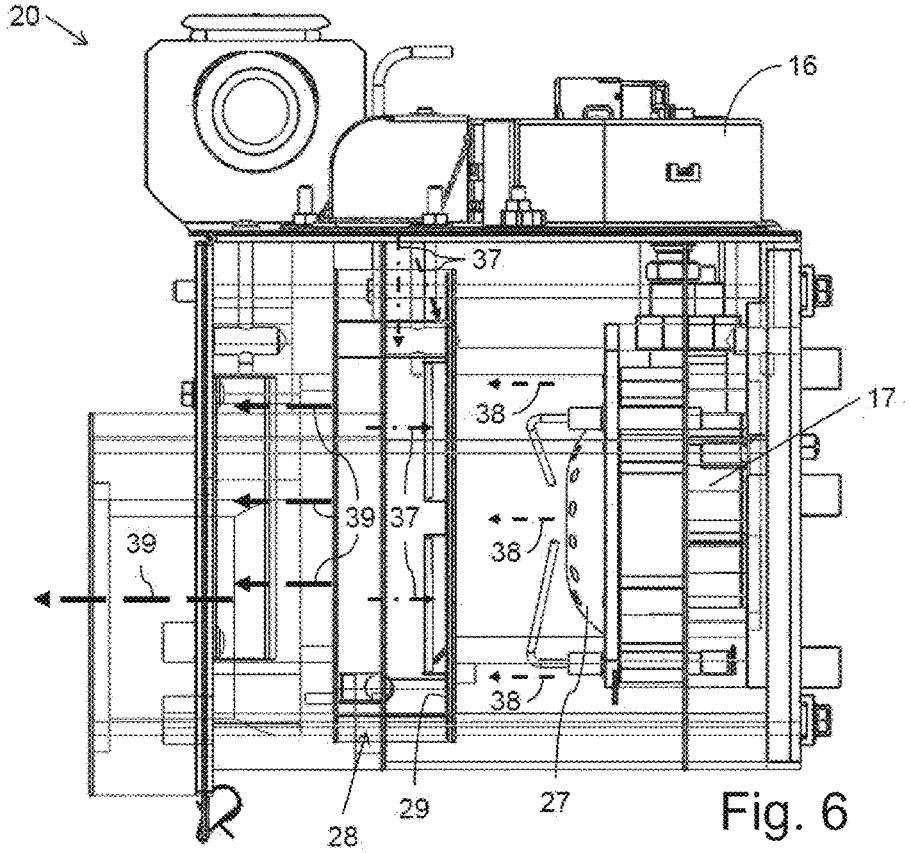

The invention is explained in more detail below with reference to the drawings. These show in:

FIG. 1 a schematic representation of a fuel cell system that can be combined with a burner system according to the invention, FIG. 2 a perspective exploded view of the burner system according to the invention, FIG. 3 a schematic representation of the media flows of the burner system, FIG. 4 a side view of the burner system with media flows, FIG. 5 a further side view of the burner system with media flows, FIG. 6 a further side view of the burner system with media flows.

In the following, a fuel cell system 1 is first described which can be combined with a burner system 20 according to the invention in order to achieve the advantages described above (FIG. 1). This fuel cell system 1 corresponds essentially to the fuel cell systems described in WO 2010/066900 A1 and WO 2015/110545 A1, to which full reference is hereby made.

WO 2010/066900 A1 discloses a humidification unit for providing a carrier gas containing fuel and water vapor for supplying a fuel cell.

WO 2015/110545 A1 shows a fuel cell system for thermally coupled reforming with reformate preparation.

The fuel cell system 1 comprises a fuel cell stack 2, which is designed as an HT-PEMFC (high-temperature polymer electrolyte fuel cell). This high-temperature fuel cell operates in a temperature range of 160° C.-180° C. The required hydrogen is obtained from methanol by a reforming process and converted into electricity in the fuel cell 2.

A carrier gas flow saturated with water and methanol vapor, which is provided by a humidification unit 3, is used for cell supply. This enables water to be recovered from the exhaust gas by means of the water cycle. This eliminates the need for external addition of water and the use of premixes.

The components and the mode of operation of the fuel cell system 1 are explained by means of an anode circuit.

In the anode circuit, two metering pumps 4, 5 deliver methanol from a methanol storage tank 13 and water into the humidification unit (media unit) 3. In the humidification unit 3, a carrier gas flow is enriched with methanol. The methanol reservoir 13 can also be used to supply the burner system 20.

The carrier gas flow is conveyed by an anode or fuel pump 6 from an anode outlet to the humidification unit 3. The saturation of the carrier gas flow with water and methanol vapor takes place in a temperature range of about 80° C., the saturated gas then flows into the internal and external reformer units 7, 8.

Within the allothermal steam reforming process, water and methanol vapor decompose to hydrogen, carbon dioxide and carbon monoxide. The resulting reformate gas contains predominantly hydrogen and is passed on to the fuel cell stack 2.

After the hydrogen has been converted into electricity in fuel cell stack 2, the reformate gas still contains carbon dioxide for the most part. The depleted reformate gas flows out of the anode and the cycle starts again from the anode pump.

The fuel cell is supplied with oxygen (air) by a cathode blower 9. The air flow of the cathode blower 9 absorbs the water produced by the electricity generation, which is condensed out in a heat exchanger and phase separator 14. The recovered water is pumped back into the humidification unit 3 by the metering pump 5.

The heating of the humidification device 3 is realized by the hot exhaust gases of the reformer device 7, 8, a catalytic burner and the cathode waste heat. In order to keep the fuel cell stack 2 at the operating temperature, it is cooled by means of an air supply device 12. This air supply device 12 can be used as a tertiary air or burner air device of the burner system 20.

The burner system 20 according to the invention can be used as a heating system for fuel cell stacks 2 of fuel cell systems 1 and is described below (FIGS. 2 to 6).

Because a HT-PEMFC requires a certain starting temperature, this temperature of approx. 165° C. can be realized by heating the fuel cell stack 2 by means of the burner system 20.

So far, the fuel cell stack was heated by an electrical heating device. Heating plates were arranged around the fuel cell stack and insulated from the outside. These heating plates require electricity throughout the entire heating process. The heating process takes about one hour and requires a high electrical power. A connected battery is therefore first discharged in order to heat up the fuel cell. As soon as the fuel cell is at its temperature, it charges the battery and the electricity can be used.

A reduction of the power requirement through the burner system 20 is possible in the form of a non-electric power source.

The burner system 20 preferably uses methanol in conjunction with a burner device 21 designed as a line or surface burner. In this way, there are only low NOx generation and high exhaust gas temperatures.

The generated heat is dissipated to the fuel cell 2 via a tertiary air device 16 with a fan.

The burner system 20 according to the invention is described in detail below (FIGS. 2 to 6).

The burner system 20 has a housing device 23. The housing device 23 is formed by four interconnected plate modules, which are preferably made of vermiculite. These plate modules are connected to each other by threaded rods and are braced with foam. Vermiculite has a low thermal conductivity and may be formed as a non-combustible sheet material. This product is offered worldwide under the brand names "Fipro", "Miprotec", "bro-TECT", "Vermilite 2000" and "Thermax". Vermiculite has a high melting point of 1315° C. and is electrically non-conductive or insulating. Instead of vermiculite, Silcawool 115-36A board can be used. In general, it is also possible to separate the functions and produce a metal housing with extra insulation (e.g. high temperature glass wool). The housing device takes over the functions of insulation and media guidance in particular.

One of these plate modules is an end plate 24. An air inlet and a support surface for a diffuser 25 of the burner device 21 are formed in the end plate 24.

A rectangular recess for the passage of a methanol line and an air line for supplying the diffuser 25 is provided in a side edge or a top wall of the end plate 24, which is located at the top in the vertical direction.

A further plate module forming a center plate 26 is mounted on the end plate 24. A side wall of the center plate 26 facing the end plate 25 is provided for receiving a burner support 27 of the burner device 21 and the opposite side wall has a recess for receiving a baffle plate of an evaporator device 28. The baffle plate forms a functions device 29.

Like the end plate 24, this center plate 26 has a recess for the methanol and air line.

An installation space for the combustion device 21 is thus formed in the area between the end plate 24 and the center plate 26.

An outlet plate 30 is connected to the center plate 26. An installation space for the evaporator device 29 is provided between the center plate 26 and the outlet plate 30.

A front plate 31 is connected to the outlet plate 30.

The housing device 23 is approximately cuboid-shaped due to the plate-shaped construction. A top plate 33 is attached to a top wall of the housing device 23.

The top plate 33 serves to place the tertiary air device 16, and a burner air supply device 41, a solenoid valve and an air shaft. The burner air supply device 41 comprises a metering orifice, a corresponding hose system and an air preheater (heating metal comparable to a hot air dryer). Without the air preheater or diffuser preheater, the burner does not start or starts poorly because the methanol condenses in the diffuser. The heater itself is located in the diffuser.

Alternatively, the diffuser can also be preheated with a directly integrated heating cartridge. In this case, the burner system has two heating cartridges.

The hot exhaust gases are divided via flow channels 33 formed in the front panel 31 and directed to the fuel cell stack 2. The flow channels 33 of the front plate 33 are linked with the fuel cell stack 2 for optimum air guidance of the hot exhaust gas.

All panel modules are made of vermiculite and are braced with threaded rods using through holes on the sides of the panels.

Furthermore, the burner system comprises the evaporator device 28 and a heating cartridge. The methanol is vaporized in the evaporator device 28.

The evaporator device 28 comprises an inlet tube 42, a trough-like upper and lower unit interconnected by heat transfer component 45 having a heat exchanger structure disposed therebetween, and an outlet tube. The trough-like upper and lower members and the heat transfer device 45 arranged therebetween form an evaporator space.

The inlet pipe 42 for inserting the liquid methanol opens into the lower element 44 of the evaporator device 28. The heating cartridge with an output of 250 W is integrated into the lower wall. A fuel pump 47 is provided for this purpose, which delivers methanol from a fuel storage tank 48.

When operating the evaporator device 48 with the waste heat or the exhaust gas flow of the burner device 21, the heat transfer device 45 ensures a good heat transfer for the evaporation of the methanol. The evaporated methanol is concentrated at the top and is conducted to the diffuser through a welded pipe via a solenoid valve. To increase the surface area of the phase interface, the heat transfer device 45 is filled with fine metal wool, preferably stainless steel wool. An upper trough (upper element) of the evaporator device 28 is also filled with stainless steel wool, a lower trough (lower element) into which the methanol first flows is filled with a solid metal foam, which also includes the heating cartridge and ensures or improves the heat conduction from the heating cartridge to the evaporator device 28.

Alternatively, the lower trough can also be made of a solid stainless steel material and the heating cartridge is located in an extra hole that has no fluid connection to the methanol distribution chamber. The dispersion chamber is preferably equipped with metal foam.

The burner device 21 comprises, among other things, the burner screen 27, the diffuser 25 and electrodes.

The burner port 27 is made of a perforated stainless steel sheet with a metal fiber coating. Holes arranged in the edge area of the burner screen 27 are provided for a secondary air flow 36. In addition, fastening holes are provided for fastening electrodes.

The fuel mixture flows through the primary holes formed in a bulge of the burner screen 27.

A metal fiber mesh is welded or a porous ceramic structure is provided on the side of the burner screen 27 facing the center plate 26. This consists of a heat-resistant Fe—Cr—Al alloy that provides protection against oxidation and high temperatures. This provides effective protection against overheating and also prevents deformation and breakage of the burner.

When the metal fiber is operated at low heat output, combustion occurs on the metal surface and the fibers glow brightly. The metal fiber is now operating in radiation mode.

The use of a metal fiber offers the following advantages:

Precise combustion with significant noise reduction

High flame stability without flashback

Dimensional stability/deformation resistance

The mixing of the gaseous fuel and the air by the starting burner fan is realized by a diffuser positioned in the end plate.

On an upper side of the diffuser 27 as well as on the end plate there are inlet openings for the fuel and the burner air supply 34.

The evaporated methanol is dosed directly into the spiral of the diffuser 27. The spiral forms a mixing device 17. The air is passed through a non-return membrane and then divided into primary air 35 and secondary air 36. The primary air 35 is mixed with the methanol vapor in the spiral and the secondary air 37 flows around the diffuser 25 into the secondary holes. The fuel mixture of gas and air accumulates in a pre-combustion chamber and flows through the primary holes of the burner screen 27.

The primary air supply is adjustable by means of a stainless steel cover on the spiral.

Furthermore, two electrodes (HighVoltage (HV) and flame monitoring (FW)) are screwed to the diffuser via the burner screen and extend in the combustion chamber over the primary area of the burner screen. The ignition spark is positioned between the ignition electrode (HV) and the burner screen, which are on electrical ground to obtain a better flame monitoring signal.

Furthermore, the burner system 20 comprises the tertiary air device 16 and a metering orifice.

The tertiary air device 16 comprises a PWM (pulse width modulation)-capable radial fan. The PWM enables precise adjustment of the fan speed and thus a controlled flow of tertiary air. A sensor line provides information about the current fan speed and can indicate a fan failure by means of a consistency check.

In addition to cooling the fuel cell 2, the tertiary fan 16 heats the fuel cell 2 by the hot exhaust air (hot gas stream 39 comprising exhaust gas stream 38 and tertiary air 37) of the burner device 21. The fan allows sufficient cooling of a fuel cell system 1 at any power level.

A further fan forms a burner air device 41 for supplying burner air 34 (primary 35 and secondary air 36). The burner air device 42, like the tertiary air device 16, is a radial blower that conveys air to the diffuser 25 via a flow metering device.

The three-pin connection makes it possible to regulate the speed via a corresponding control device.

An automatic burner control system is used to provide the ignition spark and detect the flame. This automatic burner control system detects a flame failure in a maximum of 0.8 seconds. A flame failure leads to an internal error that also closes a solenoid valve for the fuel supply. The ignition periods are integrated into an electronic system of the automatic burner control. For the starting system, an ignition period of approximately 4 to 20 seconds is used to ensure safe ignition of the fuel mixture. If the burner unit 21 has not been started within the ignition phase, the control device outputs an error.

The 3/2-way-solenoid valve 19 is used to open and close the gas pipe of the burner and is located between the evaporator device 28 and the diffuser 25. In case of malfunctions, the valve closes within a very short time and stops the fuel supply to the burner device. This ensures a safe shutdown of the burner in case of malfunctions. The valve is in the open state as soon as the automatic burner control unit operates the ignition process and is closed in the basic state.

Another safety device is a safety temperature limiter. This is arranged in a pre-combustion chamber, with the measuring sensor fixed to the diffuser. The function is based on a temperature sensor filled with a liquid. If the set temperature range is exceeded, the liquid expands from the sensor via the transmission mechanism to the snap-action switch and the circuit is opened, the solenoid valve closes. Influences of the ambient temperature are compensated by a bimetal disc. The advantage of the component is its electromechanical design, which allows temperature measurement without additional auxiliary energy. To open the circuit again, the snap-action switch must be reset manually.

Alternatively, a thermo fuse can be used. This is mounted on the back of the diffuser in a provided recess for this purpose. If the permissible temperature is exceeded in the event of a flashback, it opens the circuit to the valve, which then closes. To close the circuit again, the fuse must be replaced. A corresponding fuse wire of the thermal fuse melts irreversibly at approx. 200° C.

The burner device is spatially separated from the evaporator device by a functions device that is designed as a baffle plate with openings.

The basic concept of the burner system 20 is thus based on a surface burner with a fan, which is operated with methanol vapor. In addition, the system contains an evaporator to evaporate the liquid methanol. A radial fan with a high throughput is used to dissipate the hot or cold air.

The housing device 23 is made of four vermiculite plates that are braced together by means of a bracing system. The vermiculite plates are already milled out for the internal components and provide two exhaust ducts for the outlet of the hot gas. The evaporator device, the baffle plate of the functions device 29 and the burner device 21 comprising the diffuser 25 and the burner screen 27 are positioned in the housing. In addition, a mounting device for the burner air device 41 with solenoid valve is located on the top of the starting system.

The fresh air supply is provided on the one hand by the burner air device (primary air 35 and secondary air 36) and on the other hand by the tertiary air device 16 (tertiary air 37). The burner air 34 flows over the diffuser 25 and is divided there into primary air 35 and secondary air 36. The primary air 35 is mixed with the gas flow of the evaporator device 28 and flows through a central area of the burner screen. The secondary air is directed through the outer holes of the burner screen 27 and serves to cool and additionally oxygenate the combustion process.

A method for providing thermal energy using the burner system described above is explained below (FIG. 3).

In the start-up process, liquid methanol is provided from the tank through a pump and a 3/2-way valve 19 into the evaporator device 28. In the evaporator device 28, the liquid methanol is first evaporated by an electrically operated heating cartridge, passed through a solenoid valve and mixed by means of a spiral with primary air 35 provided by the primary/secondary air device or the burner air device 41.

The ignitable fuel-air mixture is then ignited in the combustion chamber and additionally supplied with oxygen by the secondary air 36.

An evaporator outlet is open in the heating phase and thus pressureless, therefore no check valve is necessary as pump protection. As soon as the 3/2-way valve is actuated, a connection between the evaporator device and the diffuser is opened while the connection to the outlet is closed. Methanol that escapes from the evaporator during the heating phase is returned to the system in the same way as the overflow from the methanol reservoir is fed into a phase separator cathode condensate. From there, it reaches the humidification unit and is converted into electricity.

Regarding the design positioning, the arrangement and the further advantages of the 3/2-way valve, reference is made to the corresponding paragraphs in the introduction to the description.

Subsequently, the hot exhaust gas 38 passes through the baffle plate of the functions device 29 and is here mixed with the tertiary air in order to reduce its temperature. The tertiary air flow is thus first mixed with the exhaust gas and then the hot gas or useful gas flow 39 formed from it flows through the evaporator device 29 and then on to the fuel cell stack. Otherwise, the evaporator could overheat. In this way, the evaporator device 28 no longer needs to be heated electrically. In particular, the hot gas flow heats a heat transfer structure of the fuel cell stack and heats it to operating temperature. As soon as the fuel cell stack has reached the desired operating temperature, a cooling process is initiated by means of the burner system.

The pump 6 or 47 and the primary/secondary air device 41 gradually shut down and the tertiary air device 16 cools the fuel cell stack 2 to its desired operating temperature.

The burner system 20 is operated with a liquid fuel, such as methanol. Thereby a phase transition of the liquid component into the gas phase must be ensured. The phase transition is necessary to ensure mixing of the energy carrier with the oxidant.

This process is called mixture preparation and leads to the reduction of pollutant emissions and takes first place in the evaporator device and in a downstream mixing device. The mixing device is designed in the form of a spiral and is integrally formed on a rear wall of a diffuser of the burner device. The diffuser disperses the mixed fuel gas over the burner cross-section so that it can flow homogenous through a primary region of the burner screen. The burner screen also takes part in the homogenous dispersion of the fuel gas over the burner cross-section due to the pressure loss when flowing through them.

Four sub-steps are necessary for the thermal combustion of liquid fuels.

Fuel preparation

Evaporation of the fuel

Mixture preparation

Combustion (heat release) of the mixture

In the first sub-step, the liquid energy carrier is processed by surface enlargement. This process is operated out by using atomization or dispersion systems. Atomizing or dispersing the liquid fuel serves on the one hand for fluid transport and on the other hand to increase the specific surface area. Because the evaporation of a liquid energy carrier takes place at the phase boundary surfaces, an increase of the reaction rate and thus a minimization of the process time can be achieved here.

An evaporation of a liquid medium into a gaseous component is called a phase transition. In the case of vaporization in an air environment, the fuel is mixed with air and afterwards vaporized. A direct vaporization, first represents a vaporization of the fuel, which can thereby be mixed with air in gaseous form. In the case of vaporization of methanol, the methanol is added in the evaporator and then the vaporized methanol is mixed with air in the mixing device. Due to the spatial separation of vaporization and mixing, an ignitable mixture of fuel and air is only present after the mixture is formed.

The energy for igniting a fuel mixture is provided by the ignition control.

In particular, the evaporator device 28 is designed in such a way that the evaporated fuel is discharged with a homogenous or continuous volume flow and not in a pulsating manner. The burner system 20 according to the invention prevents pulsating combustion or pulsating evaporation leading thereto by 1. preventing condensation of the fuel in burner components due to overheating of the burner vapor. 2. by compensating the pulsation of the pump by sponge-like structures in the evaporator device (porous metal foam), which cause an increase in surface area due to their low surface tension or capillary forces. Due to a pump stroke the fuel overflow can be temporarily stored in the inner structure and continuously released as steam. In this way, the fuel can also be supplied to the evaporator device 28 by means of a simply constructed pump with an unsteady delivery rate.

Furthermore, according to the invention, it is provided that a temperature of the thermal energy of the hot gas stream emitted by the burner system is adjustable. Because the hot gas temperature to which, for example, a fuel cell 2 can be subjected is limited, cool ambient air (tertiary air 37) is supplied to the exhaust gas stream 38 via the tertiary air device 16 in order to set or regulate it to a predetermined temperature. The output temperature of the hot gas stream 39 can be controlled or adjusted very precisely (+/−2° C.) by controlling the fan speed of the fan of the tertiary air device 16 accordingly.

The burner device 21 is designed in such a way that its thermal output (via temperature or volume flow) is adjustable or controllable. Depending on the application of the burner system, the required heating power can vary. In order to avoid an unfavorable cycling of the burner device (on/off) of the burner system 20 with all its disadvantages (cooling losses, electrical losses due to preheating, poorer exhaust gas values during start-up), the power of the burner device can be widely modulated independently of the output temperature. This can be done either on a small scale by adjusting a combustion lambda at constant burner air flow or over a wide range by keeping the burner lambda constant while varying the burner air supply. Nevertheless, the output temperature can be kept constant within the scope of the delivery rate of the fan of the tertiary air device, because the outgoing gas mass flow varies depending on the desired temperature level, but not the heat output.

The thermal power for starting the burner system 20 before it goes into operation and the evaporator device 28 is heated via the burner device 21 is provided by means of the heating cartridge. This is a simple and inexpensive solution.

In addition, the temperature in the evaporator device 28 can be detected via a thermocouple integrated in the heating cartridge.

This is provided to avoid overheating of the heating element and thus damage to it, and to reduce the risk of pyrolysis of the fuel. In the start phase, the heating cartridge is regulated to a maximum temperature that is below the pyrolysis temperature of the fuel used. For this purpose, the current supply of the heating cartridge is clocked.

The evaporator device can switch off an electric heater in stages by means of empirical values (temperature detection is also possible). How such empirical values can be found is described below.

Preheat:

- The heating cartridge for electrical preheating of the evaporator can be controlled via a pulse width modulation (PWM) control, e.g. with an interval of 50 ms.
- A regulation in e.g. 10% steps is intended.
- In order to prolong the life of the heating cartridge, a maximum heating power of e.g. 80% is used, as this puts less strain on the heating conductor due to the currentless phases.
- Furthermore, the temperature of the heating cartridge is detected by a thermal sensor integrated in the cartridge and limited to a maximum of 500° C. with the help of the control system. If the limit temperature is reached or exceeded, the heating power of the cartridge is gradually reduced until the constant limit temperature is reached.
- One of the indicators for burner ignition is that the cartridge heater temperature must be above 450° C. for more than 5 seconds (the others are preheating of the diffuser to min. 70° C. and at least 4 minutes heating time).
- The temperature limitation to a maximum of 500° C. is not only used to protect the heating cartridge but also to prevent pyrolysis of the methanol.
- The temperature limits are stored in the software and can be variably adjusted depending on the fuel used.

Fading Out the Heater:

- After successful ignition of the burner (fuel valve open for more than 20 seconds and an output temperature of more than 150° C.), the heating is initially reduced to 30% power.
- Then the heating power is reduced step by step (1% increments) until the heating is completely switched off. 32 system software clocks (500 ms) are counted per step.
- Whereby an active power adjustment only takes place in, for example, 10% steps, the remaining steps in between only used because of the simpler control strategy. Accordingly, a control value of 39% is started, which corresponds to only 30% of the real heating output.
- The number of required system cycles per step can be individually adapted to the fuel used.
- In addition, the integrated temperature detection integrated in the heating cartridge can be used to ensure that the temperature in the evaporator does not fall below the boiling temperature of the fuel used. This means that the shut-off steps of the heater can also be delayed or reversed if necessary.

LIST OF REFERENCE SIGNS

| | | | |
|---|---|---|---|
| 1 | Fuel cell system | 35 | Primary air |
| 2 | Fuel cell stack | 36 | Secondary air |
| 3 | Humidification unit | 37 | Tertiary air |
| 4 | Methanol dosing pump | 38 | Exhaust gas flow |
| 5 | Dosing pump air | 39 | Hot gas flow |
| 6 | Anode pump | 40 | Methanol stream |
| 7 | Internal reformer | 41 | Burner air supply unit |
| 8 | External reformer | 42 | Inlet pipe |
| 9 | Cathode blower | 43 | To element |
| 10 | Catalytic burner | 44 | Sub-element |
| 11 | Cooling fins | 45 | Heat transfer device |
| 12 | Air supply unit | 46 | Evaporator compartment |
| 13 | Methanol storage tank | 47 | Fuel pump |
| 14 | Heat exchanger/ phase separator | 48 | Methanol storage tank |
| 15 | | | |
| 16 | Tertiary air device | | |
| 17 | Mixing device | | |
| 18 | | | |
| 19 | 3/2-way valve | | |
| 20 | Burner system | | |
| 21 | Burner equipment | | |
| 22 | Tertiary air device | | |
| 23 | Housing device | | |
| 24 | End plate | | |
| 25 | Diffuser | | |
| 26 | Centre plate | | |
| 27 | Burner screen | | |
| 28 | Evaporator device | | |
| 29 | Functions device | | |
| 30 | Outlet plate | | |
| 31 | Front panel | | |
| 32 | Flow channel | | |
| 33 | Top panel | | |
| 34 | Burner air | | |

The invention claimed is:

1. A burner system for providing thermal energy, the burner system comprising:

an evaporator device for vaporizing a liquid fuel and providing completely vaporized fuel, a burner air supply device for providing burner air, a surface burner for burning a fuel mixture comprising the completely vaporized fuel and the burner air to provide an exhaust gas stream, a shielding plate with openings for passing and controlling the thermal energy of the exhaust gas stream of the surface burner, wherein the surface burner is coupled to the evaporator device via the shielding plate in such a way that, in operation, the exhaust gas flow of the surface burner provides the thermal energy and the evaporation temperature required for complete evaporation of the fuel in the evaporator device, wherein the shielding plate is provided for radiation shielding of the evaporator device as well as for mixing the hot burner exhaust gas stream with tertiary air in order to reduce a temperature of exhaust gas, so that the overall temperature of the exhaust gas is cooled to a desired suitable level for complete evaporation, and a tertiary air supply device for supplying the tertiary air to the exhaust gas stream to adjust a temperature of the exhaust gas stream by mixing with the tertiary air to form a hot gas stream, wherein the tertiary air supply device is arranged to convey the tertiary air into the exhaust gas stream between the shielding plate and the evaporator device.

2. The burner system according to claim 1, wherein the thermal energy of the exhaust gas flow can be provided in the form of diluted exhaust gas, and this thermal energy is delivered in the form of tempered air directly or via a separately designed heat exchanger device to a device coupled to the burner system, this device being an internal combustion engine or a fuel cell stack or a battery.

3. The burner system according to claim 1, wherein the surface burner comprises a burner screen and a metal or ceramic fiber mesh connected together, a diffuser, an ignition device and a flame monitoring device.

4. The burner system according to claim 1, wherein the burner air supply device is a primary/secondary air supply device which is provided for supplying primary air in order to form the fuel mixture, this being supplied to the fuel vapor prior to combustion, and/or which is provided for supplying secondary air for cooling the burner device, in particular a diffuser and/or a combustion chamber and/or for post-combustion.

5. The burner system according to claim 1, wherein the shielding plate comprises openings for passing through and controlling the thermal energy of the exhaust gas flow and/or thermally shields the evaporator device.

6. The burner system according to claim 1, wherein the evaporator device is of closed design, wherein the evaporator device comprises an evaporator space for evaporating the liquid fuel, and wherein an outlet of the evaporator device is connected to an inlet of the burner device only via a conduit section, and the evaporator device has an inlet for supplying liquid fuel.

7. The burner system according to claim 1, wherein a 3/2-way valve is arranged in a line section which connects an outlet of the evaporator device with a fuel inlet of the burner device.

8. The burner system according to claim 1, wherein the shielding plate, the surface burner, and the evaporator device are positioned within a housing with the shielding plate positioned between and spatially separating the surface burner and the evaporator device, and the surface burner directs the exhaust gas stream through the shielding plate toward the evaporator device.

9. The burner system according to claim 8, wherein the surface burner operates in radiation mode, and the shielding plate is a baffle plate that provides radiation shielding between the evaporator device and the surface burner.

10. A burner system for providing thermal energy, the burner system comprising:

an evaporator device for vaporizing a liquid fuel and providing completely vaporized fuel, a burner air supply device for providing burner air, a surface burner for burning a fuel mixture comprising the completely vaporized fuel and the burner air to provide an exhaust gas stream, a shielding plate with openings for passing and controlling the thermal energy of the exhaust gas stream of the surface burner, wherein the surface burner is coupled to the evaporator device via the shielding plate in such a way that, in operation, the exhaust gas flow of the surface burner provides the thermal energy and the evaporation temperature required for complete evaporation of the fuel in the evaporator device, wherein the shielding plate is provided for radiation shielding of the evaporator device as well as for mixing the hot burner exhaust gas stream with tertiary air in order to reduce a temperature of exhaust gas, so that the overall temperature of the exhaust gas is cooled to a desired suitable level for complete evaporation, and a tertiary air supply for supplying the tertiary air to the exhaust gas stream to adjust a temperature of the exhaust gas stream by mixing with the tertiary air to form a hot gas stream, wherein the tertiary air supply is arranged between the shielding plate and the evaporator device, wherein positions of the openings of the shielding plate are based on positions of corresponding inflow openings of a tertiary air duct into a mixing chamber where the exhaust gas stream is mixed with the tertiary air to form the hot gas stream.

11. The burner system according to claim 10, wherein the openings of the shielding plate are positioned to lie directly adjacent to corresponding inflow openings, and the exhaust gas stream meets the tertiary air at an angle of 90°.

12. The burner system according to claim 1, wherein the tertiary air supply device directs the tertiary air to mix with the exhaust gas stream between the evaporator device and the shielding plate to form the hot gas stream, which then flows through or around a heat exchanger of the evaporator device.

13. The burner system according to claim 12, wherein the tertiary air supply device cools the exhaust gas stream by providing the tertiary air to the exhaust gas stream based on the evaporation temperature.

* * * * *